US006163895A

United States Patent [19]

Davenport

[11] Patent Number: 6,163,895

[45] Date of Patent: Dec. 26, 2000

[54] PLUNGER APPARATUS

[76] Inventor: Clyde F. Davenport, P.O. Box 8127, Greenwood, S.C. 29649

[21] Appl. No.: 09/382,759

[22] Filed: Aug. 25, 1999

Related U.S. Application Data

[60] Continuation-in-part of application No. 09/120,385, Jul. 21, 1998, abandoned, which is a division of application No. 08/623,338, Mar. 27, 1996, Pat. No. 5,787,516, which is a division of application No. 08/382,917, Feb. 3, 1995, Pat. No. 5,537,694, which is a continuation-in-part of application No. 08/420,445, Apr. 10, 1995, Pat. No. 5,546,613, which is a continuation-in-part of application No. 08/033,942, Feb. 16, 1993, Pat. No. 5,261,128, which is a continuation of application No. 07/709,835, Jun. 4, 1991, abandoned, which is a continuation-in-part of application No. 07/498,287, Mar. 23, 1990, Pat. No. 5,020,166.

[51] Int. Cl.[7] ..... E03D 9/00

[52] U.S. Cl. ..... 4/255.06; 137/536; 137/543.15

[58] Field of Search ..... 4/255.03, 255.04, 4/255.06, 255.12, 255.05; 137/536, 543.15

[56] References Cited

U.S. PATENT DOCUMENTS

| | | | |
|---|---|---|---|
| 950,549 | 3/1910 | Kurrus | 4/255.03 |
| 1,605,749 | 11/1926 | McCarthy | 4/255.08 |
| 1,734,206 | 11/1929 | Fisch | 4/255.05 |
| 1,745,923 | 2/1930 | Frizell . | |
| 1,758,541 | 5/1930 | Simon . | |
| 1,804,874 | 5/1931 | Hribar . | |
| 1,821,900 | 9/1931 | Silvers . | |
| 1,836,202 | 12/1931 | Teigler . | |
| 2,039,792 | 5/1936 | Harder . | |
| 2,055,801 | 9/1936 | Perry . | |
| 2,072,555 | 3/1937 | Hengesbach et al. . | |
| 2,126,689 | 8/1938 | Pouliot . | |
| 2,267,064 | 12/1941 | Wikelund . | |
| 2,670,475 | 3/1954 | Hord . | |
| 2,736,906 | 3/1956 | Ramseur . | |
| 2,918,083 | 12/1959 | Clark et al. | 137/536 X |
| 3,023,428 | 6/1962 | Otteson . | |
| 3,315,280 | 4/1967 | Krenn . | |
| 3,537,113 | 11/1970 | Elzner . | |
| 3,632,046 | 1/1972 | Hengesbach . | |
| 3,672,380 | 6/1972 | Schuster . | |
| 3,756,253 | 9/1973 | Hengesbach . | |
| 3,808,611 | 5/1974 | Neuman . | |
| 4,053,955 | 10/1977 | Canham | 4/255 |
| 4,238,860 | 12/1980 | Dixon . | |
| 4,320,539 | 3/1982 | Li . | |
| 4,622,702 | 11/1986 | Allen . | |
| 4,674,137 | 6/1987 | Girse . | |
| 4,756,480 | 7/1988 | Fish . | |
| 4,768,237 | 9/1988 | Torti | 4/255.06 X |

FOREIGN PATENT DOCUMENTS

| | | |
|---|---|---|
| 0088817 | 3/1937 | Sweden . |

*Primary Examiner*—Charles E. Phillips
*Attorney, Agent, or Firm*—Hardaway/Mann IP Group Nexsen Pruett Jacobs & Pollard, LLP

[57] ABSTRACT

A multi-purpose water pressure plunger is provided having an adjustable valve with a regulating lever that is attached to a handle. The handle is connected to an anti-backflow valve. The anti-backflow valve is removably connected to a plunger head that is made of a soft, pliable material that can easily deform to a desired shape so as to form a seal within a drain or pipe.

15 Claims, 3 Drawing Sheets

PLUNGER APPARATUS

CROSS REFERENCE TO RELATED APPLICATIONS

This application is a continuation-in-part of application, Ser. No. 09/120,385, filed Jul. 21, 1998, ABN, which is a divisional of application Ser. No. 08/623,338, filed Mar. 27, 1996, now U.S. Pat. No. 5,787,516, which is a divisional of application Ser. No. 08/382,917, filed Feb. 3, 1995, now U.S. Pat. No. 5,537,694, which was a continuation-in-part of application Ser. No. 08/420,445, filed Apr. 10, 1995, now U.S. Pat. No. 5,546,613, which was a continuation-in-part of application Ser. No. 08/033,942, filed Feb. 16, 1993, now U.S. Pat. No. 5,261,128, which was a continuation of application Ser. No. 07/709,835, filed Jun. 4, 1991, now abandoned, which was a continuation-in-part of application Ser. No. 07/498,287, filed Mar. 23, 1990, U.S. Pat. No. 5,020,166.

BACKGROUND OF THE INVENTION

1. Field of Invention

The present invention relates to the art of drain clearing devices, and more particularly, to drain clearing devices or plunger apparatuses that utilize pressurized water to eliminate drainage obstructions which occur in bathroom pipes and the like.

2. Description of Prior Art

The art of unclogging drainage pipes is well known and has conventionally employed manually-operated devices of the type comprising a resiliently collapsible, rounded cup having an open interior cavity. Attached to the cup is an elongated handle element extending from the end thereof opposite the open interior cavity. The cup is placed over a drainage entrance, and by applying a downward and upward force to the handle, the cup is alternatively compressed and expanded. The suction caused by this motion is somewhat effective in loosening small drainage clogs, however, larger obstructions may not be budged by such manual devices. One such device is disclosed in U.S. Pat. No. 4,622,702 to Allen wherein a manually operated plunger includes a collapsible cup for covering and sealing around a drain opening.

U.S. Pat. No. 4,674,137 to Girse discloses an electrically operated cup attachment to a manually operated pumping member.

The art of clearing drainage pipes has also employed pressurized water for forcing a clog from its lodged position into the sewer system. These pressurized devices are of the type comprising a resilient drain sealing member of differing shapes and sizes. An elongated handle, having a lengthwise passage therethrough, communicates with the sealing member and extends from the end thereof opposite the sealing member. A flow of pressurized water passes into and through the handle consequently entering the drain which is proportionally embraced by the sealing member.

One such device is disclosed in U.S. Pat. No. 3,537,113 to Elzner wherein a collapsible cup of the conventional type covers and seals around the opening of a drain. A flow of pressurized water, controlled by a faucet-type valve, passes through the handle and into the drain.

U.S. Pat. No. 4,768,237 to Torti discloses a tubular handle element attached to a mushroom-shaped cup having a check valve to prevent a back flow of water. An attachment means on the opposite end of the handle allows the connection to a pressurized source of water.

U.S. Pat. No. 4,320,539 to Li discloses an elongated pipe with a manually operated plunger valve which activates a flow of pressurized water. A side arm, branching from and communicating with the pipe, is attached to a source of pressurized water by a connection means.

The U.S. Pat. No. 1,605,749, issued to McCarthy discloses a pipe cleaning apparatus having an elbow joint and an adjustable valve within a system.

The patent issued to Schuster, U.S. Pat. No. 3,672,380, discloses a cleaning device that uses pressurized water and has a nozzle arrangement.

The Canham patent, U.S. Pat. No. 4,053,955, shows a drain cleaning tool with an internal piston that is used to create a large impact force against the water and force the debris clogged within a drain to detach and free the drain.

The Krenn patent, U.S. Pat. No. 3,315,280, discloses a drain opening device that has a nipple shaped rubber head and uses an aerosol power container to create a force used to dislodge any material that may be within and blocking a drain.

Other prior art devices that teach utilizing water pressure to clear clogged drains include U.S. Pat. No. 2,267,064 to Wikelund, U.S. Pat. No. 2,736,906 to Ramseur, U.S. Pat. No. 3,023,428 to Otteson, U.S. Pat. No. 4,238,860 to Dixon, and U.S. Pat. No. 2,039,792 to Harder.

While the above prior art devices may perform satisfactorily in many instances, they are often incapable of providing a sanitary and efficient means of unclogging bathroom drains and the like. In particular, the drain clearing devices of the prior art are not constructed to allow for a secure enough seal of a drain opening, they do not permit the correct thrust of pressurized water to a clog, and they do not afford themselves to easy operation by the consumer. Furthermore, many of the prior art devices require the use of two hands to best utilize the devices, and accordingly, there exists room for improvement for a drain clearing device which provides for ease of use and can be utilized with one hand when desired.

SUMMARY OF THE INVENTION

It is an object of this invention to provide a plunger apparatus and process that is safe, easy to use and which connects to a standard source of pressurized water.

It is a further object of this invention to provide a plunger apparatus that can completely seal various drain openings and which generates a direct impact of pressurized water to a drainage clog.

It is still a further object of this invention to provide a plunger apparatus that provides for interchangeable, removable attachments for varying uses and sealing against smaller drain openings.

It is a further object of this invention to provide a hand-held water pressure plunger apparatus.

These, as well as other objects, are accomplished by providing a plunger apparatus having an adjustable valve with a regulating lever that is attached to a handle. The handle is connected to an anti-backflow valve. The anti-backflow valve is removably connected to a plunger head that is made of a soft, pliable material that can easily deform to a desired shape so as to form a seal within a drain or pipe.

The aforementioned objectives will be accomplished as well as other features and advantages of the present invention will become more apparent from the following detailed description. The description of the present invention discloses, in conjunction with the drawings which illustrate by way of example, the principles and objects of the invention.

DETAILED DESCRIPTION OF THE INVENTION

Figure 1:
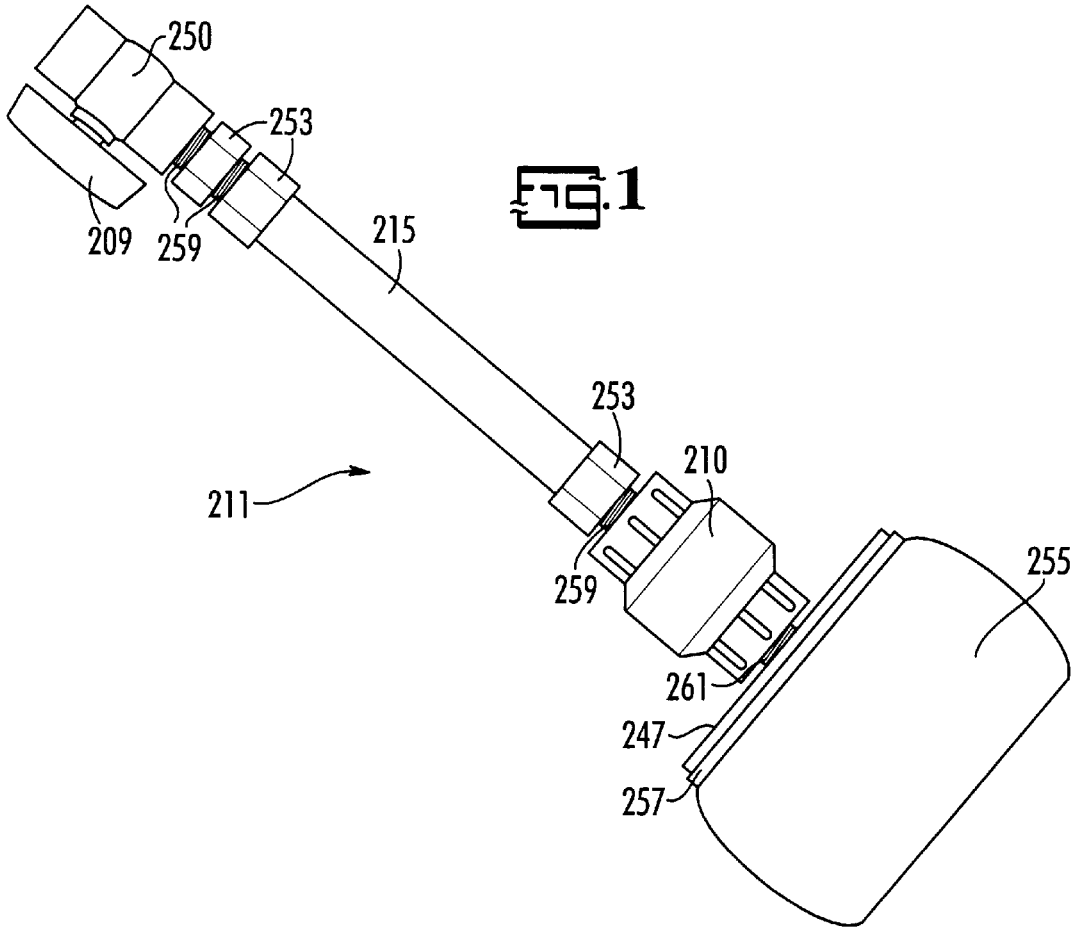
FIG. 1 is a front elevation view of a sixth embodiment of the plunger apparatus.

FIG. 1 is an elevation view of a plunger apparatus 211. The plunger 211 is used to eliminate drainage obstructions in pipes by applying pressurized water or air through the plunger 211 into the pipes forcing any obstruction to dislodge and flow through the pipe.

The plunger 211 has an adjustable valve 250 that is connected at one end to a source of pressurized water, or any other fluid and to a handle 215 of the plunger 211 at the opposite end. The handle 215 is connected to an anti-backflow valve 210 which in turn is connected to a plunger head 255. Alternative plunger head can be utilized with this plunger 211 and will be discussed in more detail below. The adjustable valve 250, handle 215, anti-backflow valve 210 and plunger head 255 are all segregable parts that are connected by one or more connectors 253, 259. Such connectors 253, 259 are conventional connectors such as male 259 and female 253 threaded connectors or slip joints. The various segregable parts can be connected to one another in various combinations and are not necessarily limited to the embodiment shown in FIG. 1. For example, a shorter or longer handle 215 may be used or the handle 215 removed from the combination completely and the adjustable valve 250 can be connected to the anti-backflow valve 210 without a handle 215 therebetween.

The adjustable valve 250 has a regulating lever or valve handle 209. The regulating lever 209 can be positioned in numerous positions from fully open to completely closed. The open position allows a complete flow of pressurized water into the plunger 211 and the closed position prevents the flow of pressurized water into the plunger 211.

The handle 215 can be of varying lengths to be used in various situations, has connectors 253 on both ends and a hollow central passage (not shown) through which pressurized water or air flows on its path from the adjustable valve 250 to the anti-backflow valve 210 and on out through the plunger head 255.

The handle 215 is connected to the adjustable valve 250 by connectors 253, 259 and can be separated, if desired, therefrom. The anti-backflow valve 210 is connected to the plunger head 255 by an inner valve connector 261.

Figure 2:
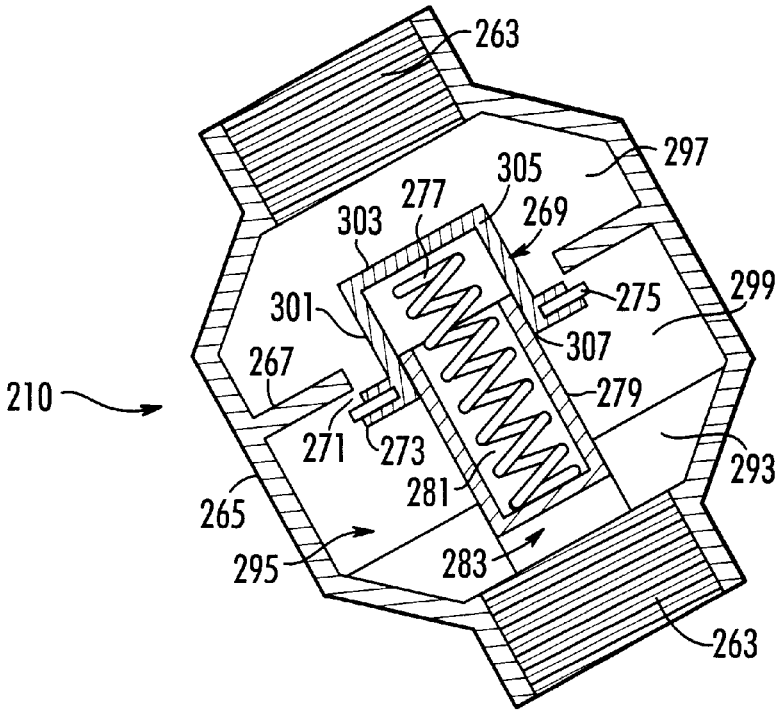
FIG. 2 is a cross-sectional view of the anti-backflow valve of the sixth embodiment thereof.

FIG. 2 is a cross-sectional view of the anti-backflow valve 210. The anti-backflow valve 210 is comprised of a valve housing 265 that defines an inner chamber 295 therein. The inner chamber 295 is divided, by a dividing wall 267, into an upper chamber 297 and a lower chamber 299. The dividing wall 267 has a center aperture 301. A spring cap 269 is positioned within the center aperture 301 and is capable of moving in an up-and-down or back-and-forth motion. In the lower chamber 299 are a plurality of fins 293 that are permanently affixed to the bottom and sides of the inside of the lower chamber 299. The fins 293 are also permanently affixed to a spring cup 279. The spring cup 279 has a spring cup central cavity 281 within which is positioned a spring 277. The spring cap 269 is placed over the top opening of the spring cup 279 so as to cover the spring 277. The spring cap 269 has a tubular shaped body that has a top wall 303, a side wall 305 and a spring cap aperture 307. Around the perimeter of the spring cap aperture 307 is a spring cap upper lip 271 and a spring cap lower lip 273 with a rubber washer 275 located therebetween. The pressurized water or air flows through the handle 215 into the anti-backflow valve 210 through a central passage within the valve connector 263 and into the upper chamber 297 of the inner chamber 295. When the pressurized water or air flows into the upper chamber 297, it pushes against the top wall 303 of the spring cap 269 which is previously held in place adjacent the dividing wall 267 by the force of the spring 277 within the spring cup 279. The pressurized water forces the spring cap 269 to press against the spring 277 causing the spring 277 to compress which moves the spring cap 269 to move towards and into the lower chamber 299, away from the dividing wall 267 where the rubber washer 275 and the dividing wall 267 form a seal to prevent water from moving from one chamber to another. This moves the rubber washer 275, breaking the seal with the dividing wall 267 and allowing pressurized water to flow into the lower chamber 299 from the upper chamber 297, around the fins 293 and out of the inner chamber 295 through the central passage within the valve connection 263 and into the plunger head 255. When the flow of pressurized water is stopped, the spring 277 forces the spring cap 269 back into place with the rubber washer 275 sealing the center aperture 301 thus preventing any water from moving back up through the anti-backflow valve 210.

Figure 3:
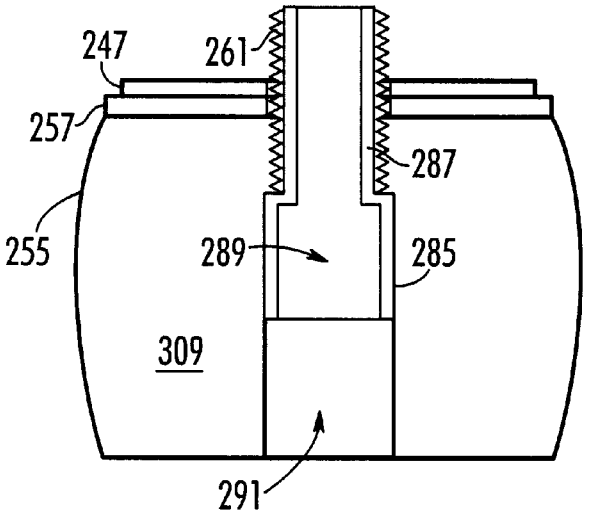
FIG. 3 is a cross-sectional view of the plunger head of the sixth embodiment thereof.

FIG. 3 is a cross-sectional view of the plunger head 255. The plunger head 255 is connected to the anti-backflow valve 210 with a head connector 261. The head connector 261 has a head connector central passage 289 that is hollow and the head connector 261 protrudes outside the plunger head 255 at one end. The opposite end of the head connector 261 is positioned within the center of the plunger head 255. The head connector 261 has an upper portion 287 that is narrower in diameter than the lower portion 285 which is wider in diameter. The change in diameter helps to maintain the head connector 261 in place within the plunger head 255 and prevents it from unnecessarily being dislodged from the plunger head 255. The plunger head 255 has a plunger head body 309 which is made of a soft, pliable, durable material such as polyurethane foam or the like. Also, the plunger head 255 can be comprised of one piece of material or more than one piece, connected together. That is, several pieces of material could be layered and attached together to form the finished product. If several pieces are used, they may be of varying densities or all the same, depending upon the stiffness desired. Within the center of the body 309, a head central passage 291 is bore. The head connector 261 is positioned within a portion of the head central passage 291. This combination allows for water to flow through the head connector central passage 289 and out through the remainder of the head central passage 291. Located at the top of the body 309 is a washer 257 which is affixed or connected to the body 309 for added strength. Placed adjacent to the washer 257 is a pressure disc 247 also for adding stability and strength to the plunger head 255. The washer 257 may be eliminated if desired. With the pressure disc 247 attached, such as through bonding, gluing, screwing, nailing, stamping or other commonly known means of attachment, to the plunger head 255, there can be sufficient support from that connection to render the washer 257 unnecessary. Both the washer 257 and the pressure disc 247 have a central aperture through which the head connector 261 passes or protrudes. The head connector 261 is removably connected to the anti-backflow valve 210. The body 309 of the plunger head 255 is made of a soft, pliable, deformable yet sturdy material that can deform and reform, hence forming a seal with the plunger 211 is placed within a drain or pipe, yet can easily be removed when desired.

Figure 4:
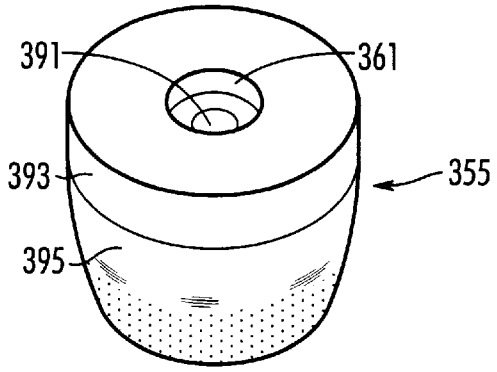
FIG. 4 is a perspective view of a second embodiment of the plunger head element.

FIG. 4 is a second embodiment of the plunger head 355. This embodiment is composed of polyurethane material that has been cut, molded or shaped into a bullet-shaped head with a central aperture or head central passage 391 extending through the middle or core of the plunger head 355. The head central passage 391 extends from one end of the plunger head 355 through the center to the other end. At one end of the head central passage 391 is located a head connector passage 363 within which a connection can be made between the head connector portion 361 of the plunger head 355 and another element such as a handle, hose, spray nozzle and etc. In this embodiment the head connector passage 363 is wider in diameter than the head central passage 391 and extends from one end of the plunger head 355 into the core of the plunger head 355 a desired distance. The distance that the head connector passage 363 extends into the core of the plunger head 355 can vary, depending upon what element it will be connected with, such as a head connector 261 (shown in FIG. 1) or a handle 215 (shown in FIG. 1), a hose (not shown), a hose nozzle (not shown) or anything the user desires. The plunger head 355 can be comprised of a single layer of polyurethane or multiple layers. The preferred embodiment shown in FIG. 4 discloses a first layer 393 attached to a second layer 395 wherein the one end of the second layer 395 is tapered to a conical shape so as to better fit into a drain, sink, toilet bowl or other area where the plunger 211 may be used. If multiple layers of polyurethane are used, they may be of the same density, thickness and stiffness or of varying densities, thicknesses and stiffnesses. For example, the first layer 393 may be stiffer and more dense than the second layer 395 so as to provide support to the top portion of the plunger head 355. The second layer 395 may not be as stiff or dense as the first layer 393 hence allowing the second layer 395 to be more pliable and capable of deforming more easily than the first layer 393 which ultimately allows the plunger head 355 to deform to the shape of the drain or opening within which it is placed.

Figure 5:
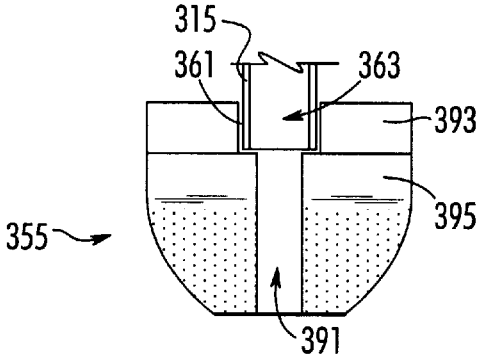
FIG. 5 is a cross-sectional view of the second embodiment of the plunger head element.

FIG. 5 is a cross-sectional view of the second embodiment of the plunger head 355 shown in FIG. 4. The cross-sectional view more clearly depicts the layering construction of the first layer 393 and the second layer 395 of polyurethane. This view also shows the relationship of the head connector portion 361 having a wider diameter than the head central passage 391. The head connector portion 361 is of a pliable nature and self-actuating to fit and secure to various type of connections. For example, a handle 315, a spray nozzle, the type commonly used with a garden hose, with a threaded end can be screwed into the head connector passage 363 directly and the head connector portion 361 will adapt to fit securely with the threaded end of the spray nozzle. Another example of the pliable nature of the head connector portion 361 is that a hose of a slightly larger diameter can be inserted into the head connector passage 363 and a snug friction fit will form preventing the hose from easily falling out. Another method in which the pliable nature of the plunger head 355 is capable of working is by inserting or screwing threaded connectors into the plunger head 355. While the head connector portion 361 of the plunger head 355 is not threaded, it will deform or conform to the object which is inserted therewithin and form a connection. Therefore, the plunger head 355 is self-adapting to fit a variety of elements that may be connected therewith. This allows the user of the plunger head great flexibility and adaptability because the plunger head 355 can be used with numerous different elements whether they are standard, conventional or custom formed. The self actuating nature of the polyurethane allows the plunger head 355 to be used with a variety of tools and it also allows the plunger head 355 to be reused on other tools and elements. Once an element or tool has been removed from within the head connector passage 363, the head connector portion 361 of the head connector passage returns to its natural state. Therefore, the head connector portion 361 temporarily deforms to fit the element inserted therein, but does no permanently take on that deformation as when the element is removed. This allows the plunger head 355 to be used numerous times with various types of elements having different sizes and shapes without permanently damaging or changing the structure of the plunger head 355 and its head connector portion 361 within its head connector passage 363.

Figure 6:
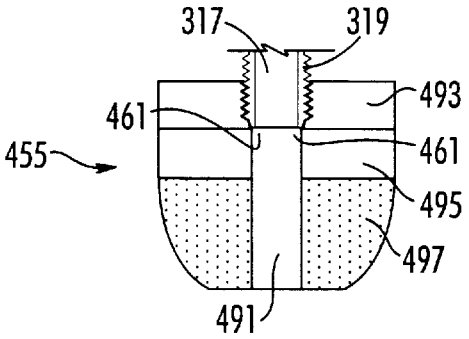
FIG. 6 is a cross-sectional view of a third embodiment of the plunger head element.

FIG. 6 is a cross-section view of a third embodiment of the plunger head 455 for this plunger 211. This embodiment is very similar in nature to the previously described second embodiment with two primary differences: (1) the head central passage 491 is one diameter throughout and does not have a wider diameter at one end where the head connector portion 461 is located, and (2) there are three distinct layers of polyurethane shown.

The third embodiment of the plunger head 455 can be used in the same manner as the other embodiments with a variety of elements and attachments also, such as a head connector 317 with threads 319, but is not limited thereto. One unique aspect of this invention is the pliable, adaptable nature of the material used to make the plunger head 455. As shown in this figure, the material can easibly adapt to a threaded insert 319 without being formally threaded on its own. That is, the pliable nature of the material of the plunger head 455 inherently or automatically adapts to the corresponding shape of the object that is inserted into it. For example, if the object inserted into the head connector portion 461 is a handle (not shown) with threads 319, the inside walls of the head connector portion 461 take on the shape of the threads 319 so that there is a snug, tight connection and the threaded connector is allowed to connect with the head connector portion 461 even though the head connector portion 461 was not originally threaded. Just as the material of the plunger head 455 adapts to a specific shape or contour of an object, when the object is removed, the plunger head 455 regains its original position and shape. This embodiment is composed of a first layer 493, a second layer 495 and a third layer 497 of polyurethane. While this particular embodiment has three layers and number of layers may be used, including a single layer. By using multiple layers, the strength, stability and ability to deform of the plunger head 455 can be specifically designed and controlled. For example, if a stiffer plunger head 455 is desired, stiffer types of polyurethane could be used as opposed to a more pliable version. Also, the thicknesses of the layers can vary depending upon the needs of the user. As shown in contrast to the plunger head 255 shown in FIG. 1, the overall shape and design of the plunger head 455 can be varied also to fit more specifically whatever type of aperture or drain the plunger 211 is going to be used in.

It is therefore shown that the present invention provides a multi-purpose water pressure plunger with components that are interchangeable for sealing and clearing various drain openings.

It is further shown that the present invention provides a multi-purpose water pressure plunger which provides a removable attachment for sealing against smaller drain openings.

It is further shown that the present invention provides a multi-purpose, hand-held water pressure plunger and process of using the same which can also utilize a standard as well as independent source of pressurized fluid to clear clogged drains.

As various modifications will become apparent to those of skill in the art from a reading of the above description, such modifications are embodied within the spirit and scope of this invention as measured by following the appended claims.

The water pressure plunger described herein and illustrated in the drawings is subject to other advantages and modifications that may be apparent to those of ordinary skill in the art without departing from the spirit and scope of the appended claims. Accordingly, the invention is to be limited only by the scope of the following claims and their equivalents.

What is claimed is:

1. A plunger apparatus comprising:

an adjustable valve having a connecting means for connecting to a fluid supply source and a regulating lever for regulating the flow of fluid through said plunger, said regulating lever being positionable in a plurality of positions ranging from fully open to completely closed;

a handle having a hollow interior and being connected to said adjustable valve;

an anti-backflow valve connected to said handle, said anti-backflow valve including, a valve housing having an inner chamber;

said inner chamber being divided into an upper chamber and a lower chamber by a dividing wall having a central aperture and a spring cap positioned within said central aperture, wherein said spring cap is capable of being moved to various positions and such positions either allowing said central aperture to remain open and allow fluid to flow therethrough or to be closed and prevent fluid from flowing through said central aperture;

a plunger head connected to said anti-backflow valve; and a plurality of connectors for connecting said adjustable valve, said handle, said anti-backflow valve and said plunger head together, wherein said plunger is used to unstop clogged drains and pipes by forcing pressurized fluid into said drains and pipes.

2. The plunger apparatus of claim 1, wherein:

said anti-backflow valve further comprises a plurality of fins;

said plurality of fins are connected to said inner chamber;

a spring cup is connected to said plurality of fins; and a spring located within said spring cup, and said spring cap is located on said spring, wherein said spring maintains said spring cap within said central aperture.

3. The plunger apparatus of claim 2, wherein:

said spring cap further comprises a tubular shape body having a top wall; a side wall; a cap aperture within said side wall; an upper lip and a lower lip surrounding the perimeter of said cap aperture and a washer positioned within said upper lip and said lower lip, wherein said washer forms a seal between said upper chamber and said lower chamber of said anti-backflow valve when said spring cap is placed in a sealing position.

4. The plunger apparatus of claim 3, wherein:

said plunger head is further comprised of a head connector having two ends and a central passage therein and a plunger head body;

one end of said head connector is partially located within said plunger head body;

a washer is attached to said plunger head body;

a pressure disc is adjacent said washer;

said washer and said pressure disc each have central apertures through which the other end of said head connector passes and is connected to said anti-backflow valve, wherein said plunger head is capable of being placed within various sized and shaped pipes and drains.

5. The plunger apparatus of claim 4, wherein:

said plunger head body is made of a pliable, durable, deformable material, wherein said plunger head body is adaptable to fit any size drain or pipe and can deform so as to effectively form a seal of said pipe or drain.

6. A water pressure plunger comprising:

an adjustable valve capable of being connected to pressurized water source;

said adjustable valve having a multi-position regulating lever for regulating the amount of water flowing through said plunger;

a handle having a hollow interior and being connected at one end to said adjustable valve;

an anti-backflow valve having a housing with an inner chamber a dividing wall in said housing creating an upper chamber and a lower chamber, said dividing wall presenting a central aperture;

a spring cap positioned within said central aperture and being shiftable between open and sealed positions and a spring mechanism in said housing biasing said spring cap to said closed position;

said spring cap being shifted to said open position upon the difference in fluid pressure in said upper and lower chambers reaching a predetermined valve;

said handle being connected to said anti-backflow valve at an opposite end; and a plunger head having a plunger head body with a head central passage which water flows through, wherein said water pressure plunger can be placed within a clogged drain or pipe and direct pressurized water into said drain or pipe in an effort to unclog said drain or pipe.

7. The water pressure plunger of claim 6, wherein:

said anti-backflow valve has a valve central passage;

a plurality of fins are connected to said lower chamber adjacent said valve central passage;

a spring cup is connected to said plurality of fins;

a spring is positioned within said spring cup; and said spring cap is positioned on said spring, wherein said spring moves said spring cap in an up-and-down motion within said central aperture allowing said spring cap to open said central aperture or seal said central aperture.

8. The water pressure plunger of claim 7, wherein:

said plunger head further comprising a head connector with a head connector central passage therethrough;

said head connector is located at one end within said plunger head body and protrudes out of said plunger head at the opposite end;

said plunger head having a washer attached to one end of said plunger head body;

a pressure disc located adjacent said washer;

said washer and said pressure disc each having a center aperture through which said head connector passes, wherein said washer and said pressure disc add stability to said plunger head.

9. The water pressure plunger of claim 8, wherein:

said plunger head body is made of a pliable, durable, deformable material; and said plunger has a central passage, wherein said pressurized water flows through said central passage from one end of said plunger through said plunger and out the opposite end of said plunger into a drain or pipe forcing any debris within said drain or pipe to dislodge and flow through the drain or pipe.

10. A water pressure plunger comprising:

an adjustable valve capable of being connected to pressurized water source and including a multi-position regulating lever for regulating the amount of water flowing through said plunger;

a handle having a hollow interior and being connected a tone end to said adjustable valve;

an anti-backflow valve having a housing with an inner chamber;

a dividing wall in said housing creating an upper chamber and a lower chamber, said dividing wall presenting a central aperture;

a spring cap positioned within said central aperture, said spring cap being capable of being moved allowing said central aperture to be open or sealed off;

a spring mechanism biasing said spring cap toward a sealed of position;

said handle being connected to said anti-backflow valve at an opposite end; and a plunger head having a plunger head body with a head central passage which water flows through, said plunger head being comprised of a pliable material that is self-adapting to fit various contours, wherein said water pressure plunger can be placed within a clogged drain or pipe and direct pressurized water into said drain or pipe in an effort to unclog said drain or pipe.

11. The water pressure plunger of claim 10, wherein:

said anti-backflow valve has a valve central passage;

a plurality of fins are connected to said lower chamber adjacent said valve central passage;

a spring cup is connected to said plurality of fins;

a spring is positioned within said spring cup; and said spring cap is positioned on said spring, wherein said spring moves said spring cap in an up-and-down motion within said central aperture allowing said spring cap to open said central aperture or seal said central aperture.

12. The water pressure plunger of claim 11, wherein:

said plunger head further comprising a head connector with a head connector central passage therethrough;

said head connector is located at one end within said plunger head body and protrudes out of said plunger head at the opposite end;

said plunger head having a washer attached to one end of said plunger head body;

a pressure disc located adjacent said washer;

said washer and said pressure disc each having a center aperture through which said head connector passes, wherein said washer and said pressure disc add stability to said plunger head.

13. The water pressure plunger of claim 12, wherein:

said plunger head body is made of a pliable, durable, deformable material; and said plunger has a central passage, wherein said pressurized water flows through said central passage from one end of said plunger through said plunger and out the opposite end of said plunger into a drain or pipe forcing any debris within said drain or pipe to dislodge and flow through the drain or pipe.

14. The water pressure plunger of claim 13, wherein:

said plunger head body is further comprised a plurality of layers, each layer being a different stiffness and density than the other layers.

15. The water pressure plunger of claim 14, wherein:

said plunger head body is comprised of polyurethane.

* * * * *